US007496989B2

(12) United States Patent
Walker et al.

(10) Patent No.: US 7,496,989 B2
(45) Date of Patent: Mar. 3, 2009

(54) HANDLE ASSEMBLY FOR TOOL

(75) Inventors: Andrew Walker, Newton Hall (GB); Brian Wadge, Coxhoe (GB); Tim McKay, Fair Meadows (GB); Nigel Robson, Lowfell Gateshead (GB); Ian Sokell, Spennymoor (GB)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/667,941

(22) Filed: Sep. 22, 2003

(65) Prior Publication Data

US 2004/0098836 A1 May 27, 2004

(30) Foreign Application Priority Data

Oct. 28, 2002 (GB) ..... 0224955.5

(51) Int. Cl.
*B25G 1/10* (2006.01)

(52) U.S. Cl. ..... 16/430; 16/421

(58) Field of Classification Search ..... 16/110.1, 16/111.1, 421, 430, 431; 451/524; 173/170, 173/162.1; 408/124, 241 R
See application file for complete search history.

(56) References Cited

U.S. PATENT DOCUMENTS

| | | | | | |
|---|---|---|---|---|---|
| 588,794 | A | | 8/1897 | Granger | |
| 593,162 | A | | 11/1897 | Miller | |
| 3,713,350 | A | | 1/1973 | Brilando | |
| 3,849,943 | A | * | 11/1974 | Thomas et al. | 451/357 |
| 4,416,166 | A | | 11/1983 | Jannard et al. | |
| 4,667,749 | A | | 5/1987 | Keller | |
| 4,721,021 | A | * | 1/1988 | Kusznir | 81/22 |
| 4,739,536 | A | | 4/1988 | Bandera et al. | |
| 4,974,286 | A | | 12/1990 | Stowell et al. | |
| 5,083,376 | A | * | 1/1992 | Lentino | 30/392 |
| 5,088,734 | A | | 2/1992 | Glava | |
| 5,267,487 | A | | 12/1993 | Falco et al. | |
| 5,280,735 | A | | 1/1994 | Kuipers et al. | |
| 5,298,821 | A | * | 3/1994 | Michel | 310/47 |
| 5,353,474 | A | * | 10/1994 | Good et al. | 16/421 |
| 5,355,552 | A | * | 10/1994 | Huang | 16/421 |
| 5,530,989 | A | * | 7/1996 | Remmert et al. | 16/430 |
| 5,722,116 | A | * | 3/1998 | Lin | 16/436 |
| 5,860,183 | A | * | 1/1999 | Kam | 15/167.1 |
| 5,893,297 | A | | 4/1999 | Rowe | |
| 5,926,911 | A | | 7/1999 | Chen | |
| D418,730 | S | * | 1/2000 | Main | D8/68 |

(Continued)

FOREIGN PATENT DOCUMENTS

| | | |
|---|---|---|
| DE | 709757 | 8/1941 |

(Continued)

*Primary Examiner*—Chuck Y. Mah
(74) *Attorney, Agent, or Firm*—Harness, Dickey & Pierce, P.L.C.

(57) ABSTRACT

A handle assembly for a power tool 1 comprises a housing 2 defining a handle 4 and housing a motor for actuating an output member of the tool, such as a drill bit or jigsaw blade. The handle assembly comprises at least one flexible sheet 8 adapted to be mounted to a surface of the handle of the power tool and having a series of protrusions 10 adapted to be engaged by a hand of a user of the tool. The protrusions 10 retain at least one gaseous vibration damping material such as air between the flexible sheet 8 and the surface of the handle 4.

13 Claims, 8 Drawing Sheets

U.S. PATENT DOCUMENTS

| | | | | |
|---|---|---|---|---|
| D419,413 | S * | 1/2000 | Heun | D8/68 |
| 6,058,815 | A * | 5/2000 | Habermehl | 81/434 |
| 6,101,628 | A | 8/2000 | Earl | |
| 6,108,870 | A | 8/2000 | Lo | |
| 6,128,808 | A | 10/2000 | Jansson et al. | |
| 6,148,701 | A * | 11/2000 | Lee | 81/489 |
| 6,153,277 | A * | 11/2000 | Chang | 428/35.2 |
| 6,158,910 | A | 12/2000 | Jolly et al. | |
| 6,206,107 | B1 * | 3/2001 | Wadge | 173/217 |
| 6,237,193 | B1 | 5/2001 | Skerker et al. | |
| 6,247,204 | B1 | 6/2001 | Hamby et al. | |
| 6,308,378 | B1 | 10/2001 | Mooty et al. | |
| 6,338,290 | B1 | 1/2002 | Lin | |
| 6,591,456 | B2 * | 7/2003 | DeLuca et al. | 16/431 |
| 6,647,582 | B1 * | 11/2003 | Rechelbacher | 15/143.1 |
| 6,721,997 | B2 * | 4/2004 | Hua | 16/431 |
| 6,805,207 | B2 * | 10/2004 | Hagan et al. | 173/170 |
| 2002/0020532 | A1 | 2/2002 | Shonfeld et al. | |
| 2003/0024543 | A1 * | 2/2003 | Wolf | 132/212 |
| 2003/0110585 | A1 * | 6/2003 | Rechelbacher | 15/143.1 |
| 2004/0040120 | A1 * | 3/2004 | Zaidman | 16/436 |
| 2004/0078936 | A1 | 4/2004 | Walker et al. | |

FOREIGN PATENT DOCUMENTS

| | | |
|---|---|---|
| DE | 1006359 | 4/1957 |
| DE | 20002343 | 4/2000 |
| DE | 10139771 | 8/2001 |
| DE | 100 55 395 A1 | 5/2002 |
| EP | 0429408 | 5/1991 |
| EP | 0481245 | 12/1994 |
| EP | 0738525 | 10/1996 |
| EP | 0893335 | 1/1999 |
| EP | 0995553 | 4/2000 |
| EP | 0687152 | 3/2001 |
| GB | 1464089 | 2/1977 |
| JP | 61-209884 | 9/1986 |
| JP | 7-205055 | 8/1995 |
| JP | 10-191745 | 7/1998 |
| SV | 477236 | 10/1975 |
| WO | WO-94/19990 | 9/1994 |
| WO | WO 02/30731 A1 | 4/2002 |
| WO | WO-02/38341 | 5/2002 |

* cited by examiner

HANDLE ASSEMBLY FOR TOOL

The present invention relates to handle assemblies for tools, and relates particularly, but not exclusively, to handle assemblies having combined friction gripping and vibration damping properties, for power tools in which an output shaft is driven by a motor.

Known power tools, such as power drills in which a drill bit is rotated by an output shaft which is in turn rotated by means of an electric motor, generate significant amounts of vibration, which can under certain circumstances limit the length of time during which the tool can be used continuously, and may even cause injury to users of the tool. In addition, the housing of such tools is generally made from a durable plastics material on which it can be difficult for a user of the tool to maintain a grip when the tool is in use for a sustained period.

U.S. Pat. No. 6,308,378 discloses a gripping arrangement for a handle of a power tool in which the sides of the handle are provided with frictional gripping zones, each side of the handle including a plurality of alternating gripping zones of a softer material and a harder material. The softer material used is generally a thermoplastic elastomer or rubber material, and the harder material is generally the same material as that from which the tool housing is formed.

This known arrangement suffers from the drawback that because the softer material performs the dual functions of providing a friction grip and vibration damping, the choice of material constitutes a compromise in that although it will have acceptable friction reducing and vibration damping properties, the performance of the handle is limited because a material having optimum frictional properties will generally have unacceptable vibration damping properties, and vice versa.

WO02/38341 discloses a grip handle for a hand-held machine tool in which a hand grip is separated from the remainder of the housing by a vibration damping element consisting of an inflatable annular air filled cushion. An additional handle is provided which has a tubular grip element surrounding a further annular air cushion.

This known arrangement suffers from the drawback that the use of annular air filled cushions makes the tool of complicated construction, which in turn increases the cost of manufacture of the tool.

Preferred embodiments of the present invention seek to overcome the above disadvantages of the prior art.

According to an aspect of the present invention, there is provided a handle assembly for a power tool comprising a housing defining a handle and housing a motor for actuating an output member of the tool, the assembly comprising at least one flexible member adapted to be mounted to a surface of the handle of the power tool and having an engaging portion adapted to be engaged by a hand of a user of the tool, wherein said engaging portion is adapted to retain at least one gaseous vibration damping material between the engaging portion and the surface of the handle.

By providing at least one flexible member having an engaging portion adapted to retain at least one gaseous vibration damping material between the engaging portion and the surface of the handle, this provides the advantage of enabling the material of the flexible member to be chosen to have the optimum frictional properties to enable a user to maintain a grip on the tool, and the vibration damping material at the same time to have the optimum vibration damping properties, while at the same time enabling the gaseous vibration damping material of the handle assembly to be held in position by means of a single layer of material, thus enabling the assembly to be manufactured at significantly less cost.

The assembly may further comprise at least one cover plate for location over the or each said flexible member in position on the surface of the handle.

At least one said cover plate may comprise a respective substantially rigid member having at least one respective aperture for enabling at least part of said engaging portion to protrude therethrough.

At least one said flexible member may define in use at least one compartment containing at least one said vibration damping material between the engaging means and the surface of the handle.

At least one said vibration reducing material may be air.

According to another aspect of the present invention, there is provided a tool comprising:

a housing;

a motor within the housing adapted to actuate an output member of the tool; and a handle assembly as defined above.

Said engaging portion may have an outer surface including at least one material of higher coefficient of friction than the material of the housing of the tool.

A preferred embodiment of the invention will now be described, by way of example only and not in any limitative sense, with reference to the accompanying drawings, in which.

Figure 1A:
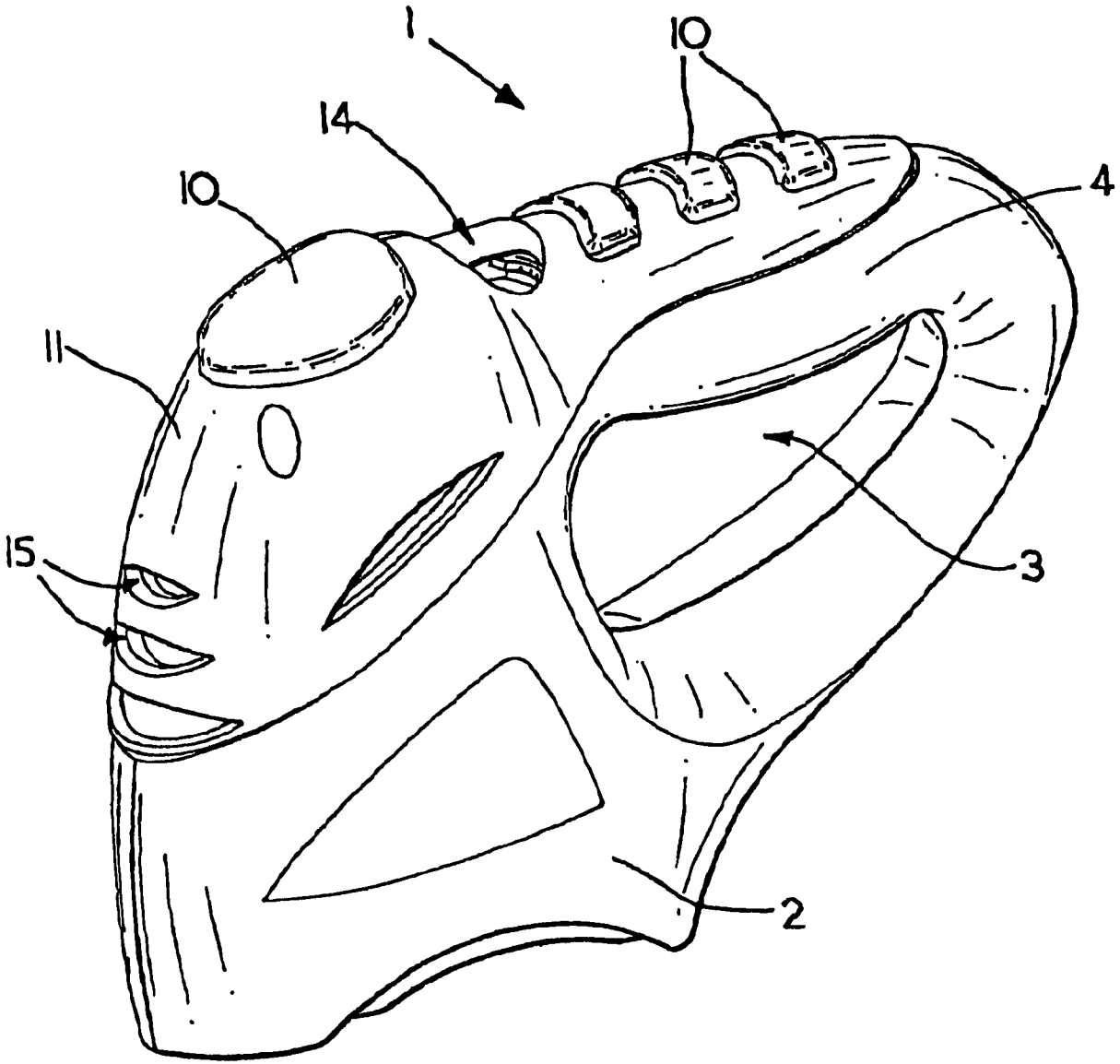
FIG. 1A is a perspective view of part of a housing of a power tool embodying the present invention.
Figure 2:
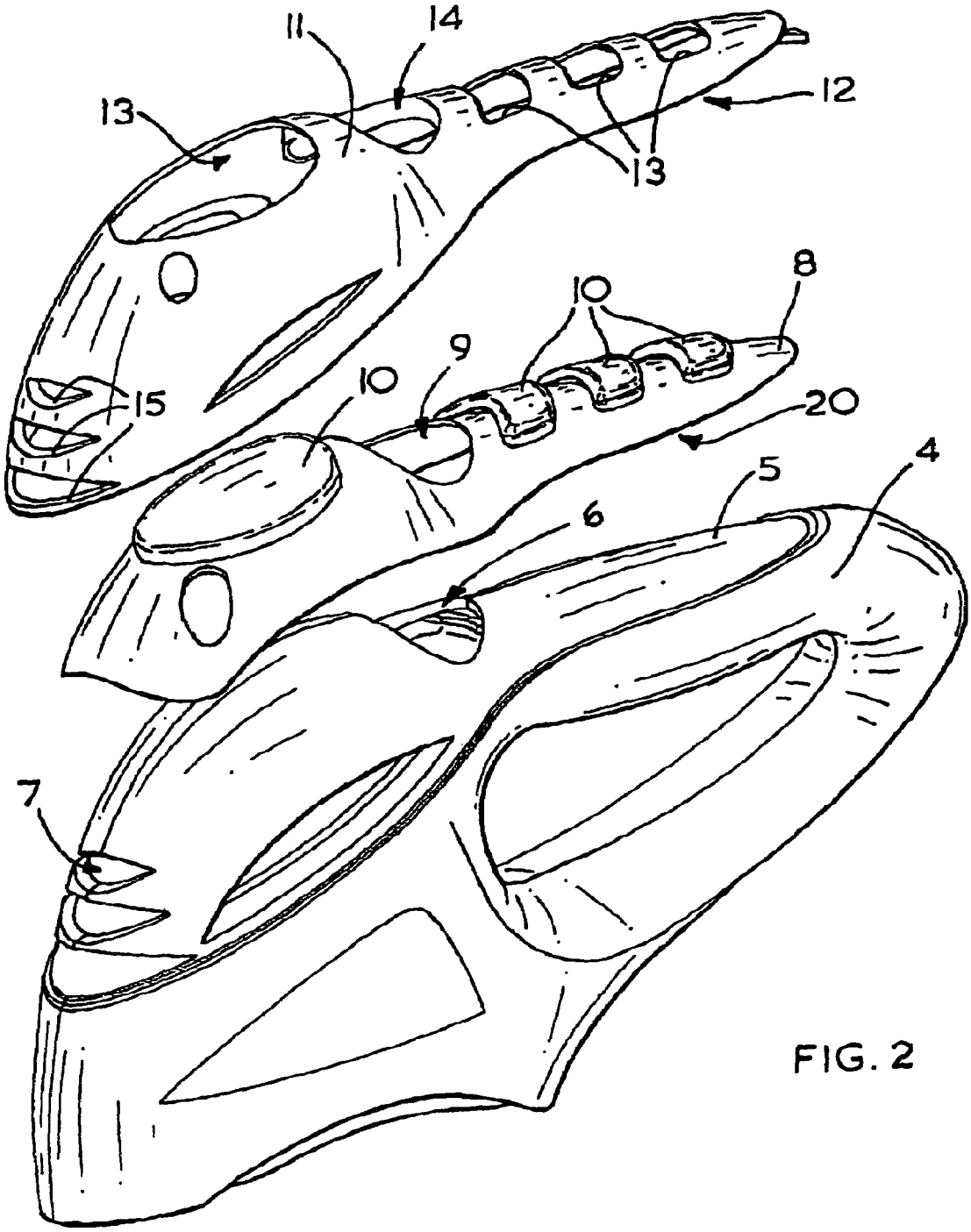
FIG. 2 is an exploded perspective view of the partial housing of FIG. 1.

Referring to FIGS. 1A and 2, a power tool 1 such as a drill or jigsaw comprises a housing 2 defining an aperture 3 bounded on one side thereof by a handle 4, the housing 2 containing a motor (not shown) for actuating an output member such as a drill bit or jigsaw blade (not shown).

The housing 1 is formed from a generally durable plastics material, as will be familiar to persons skilled in the art, and has a recessed portion 5 on a generally smooth upper surface of the handle 4, the recessed portion 5 being provided with a recess 6 containing an actuating switch (not shown) for turning the tool 1 on and off. The housing 2 is provided with ventilation apertures 7 at one end of the recessed portion 5 to allow cooling of the interior of the housing 2.

A flexible sheet 8, of thermoplastic elastomeric material such as a silicone rubber or a polypropylene and butadiene compound having a coefficient of friction higher than that of the material from which the housing 2 is made, is formed by means of a suitable method such as moulding. The sheet 8 has a periphery shaped to fit inside the periphery of recessed portion 5 to cover all of the recessed portion 5 except that part in which the ventilation apertures 7 are provided, and the flexible sheet 8 is provided with a through-aperture 9 to allow access to the actuating switch in recess 6. The flexible sheet 8 is also provided with a series of protrusions 10, each of which defines an air-filled chamber 16 between the sheet 8 and the upper surface of the handle 4 of the housing 2 when the sheet 8 is placed in position on the upper surface of the recessed portion 5. The flexible sheet 8 may be fixed in position on the housing 2 by means of a suitable welding technique such as heat staking and/or ultrasonic vibration, as will be familiar to persons skilled in the art.

A securing plate 11 of durable plastics material, such as the material from which the housing 2 is constructed, has an internal surface 12 corresponding generally to the external (i.e. upper) surface of the flexible sheet 8. The securing plate 11 is provided with a series of first apertures 13 for allowing the protrusions 10 of the sheet 8 to protrude therethrough when the plate 11 is mounted to the handle 4 to secure the flexible sheet 8 in place, a second aperture 14 co-operating with the aperture 9 to allow access to the actuating switch in recess 6, and a series of third apertures 15 cooperating with the ventilation apertures 7 in the housing 2.

Figure 3A:
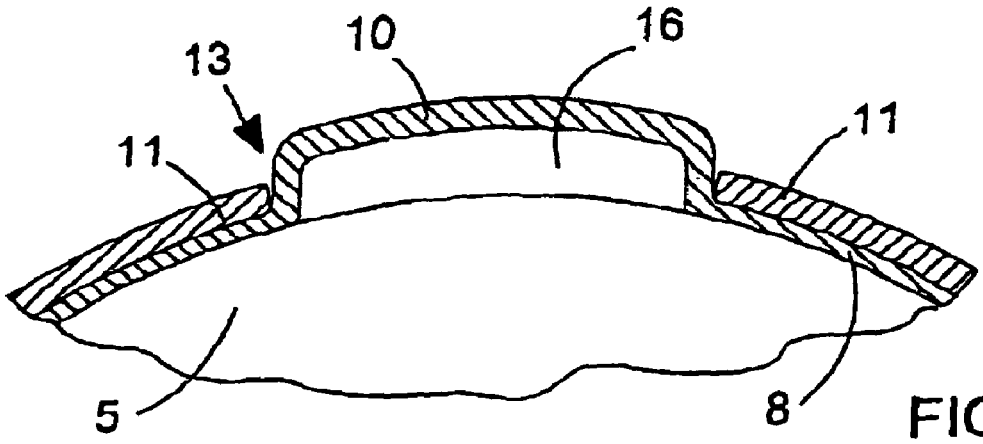
FIGS. 3A to 3C are side cross-sectional views of three alternative forms of the handle, flexible sheet and securing plate of FIGS. 1 and 2.

Referring to FIG. 3A, a flexible sheet 8, having protrusion 10, is sandwiched between securing plate 11 and recessed portion 5 of handle 4. Protrusion 10 extends through first aperture 13 and along with recessed portion 5 of handle 4 defines air-filled chamber 16.

Figure 3B:
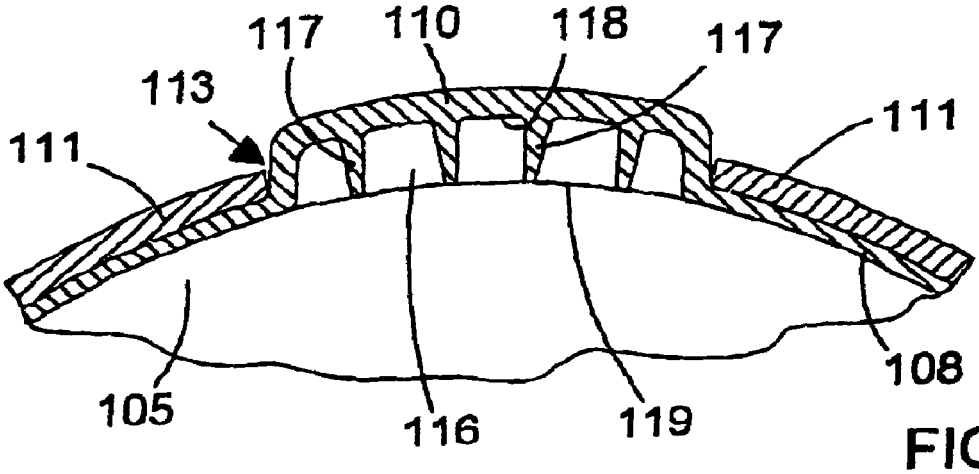

Referring to FIG. 3B, in which parts common with the embodiment of 3A are denoted by like reference numerals increased by 100, protrusion 110 is provided with a plurality of resilient ribs 117 extending from an internal surface 118 of protrusion 110 to surface 119 of recessed portion 105. Ribs 117 provide an additional damping by their own resilience and/or by the formation of pockets of air within the air filled chamber 116. Ribs 117 may be formed into a pattern such as parallel lines or concentric rings.

Figure 3C:
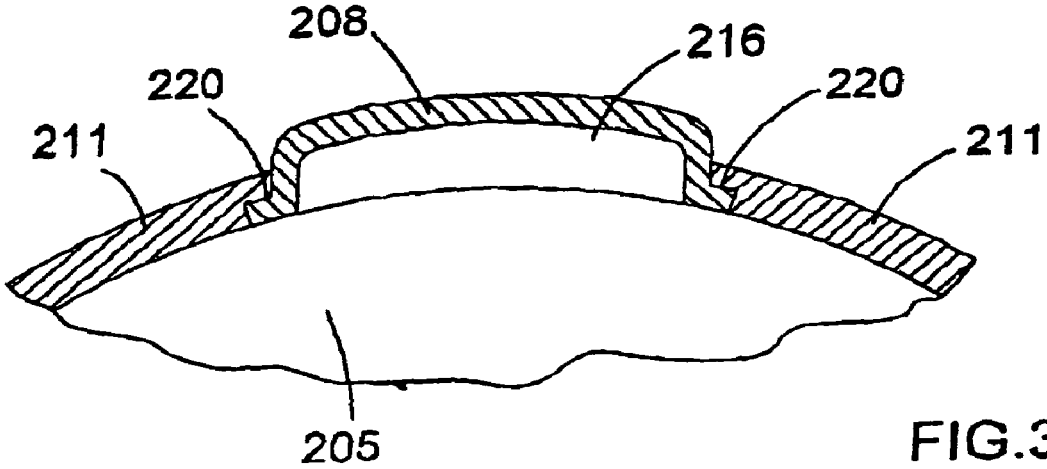

Referring to FIG. 3C, in which parts common with the embodiment of 3A are denoted by like reference numerals increased by 200, flexible sheet 208 is moulded so as to bond, at junction 220, with securing plate 211. As a result recessed portion 205 is in direct contact with securing plate 211. Ribs of the type shown in FIG. 3B may also be included. Sheet 208 and securing plate 211 may be bonded to each other by an over-moulding operation or by the sheet 208 being formed in the second shot in a twin shot injection moulding process.

The operation of the handle 4 of the tool 1 of the invention will now be described.

When a user's hand (not shown) grips the tool 1 when in use, the user's hand comes into contact with the gripping portion which includes securing plate 11 and the protrusions 10 beneath which the air filled chambers 16 are located. As a result, vibrations generated by the motor in the tool housing 2 are damped by the air-filled chambers 16 beneath protrusions 10, and the user's grip on the tool is maintained by contact between the user's hand and the high friction material of the flexible sheet 8. It can therefore be seen that by suitable choice of material of the flexible sheet 8, the frictional properties of the sheet 8 can be optimized, while the vibration damping properties of the air-filled chambers 16 are generally superior to the vibration damping properties of known high friction materials used in conventional handle assemblies.

Figure 1B:
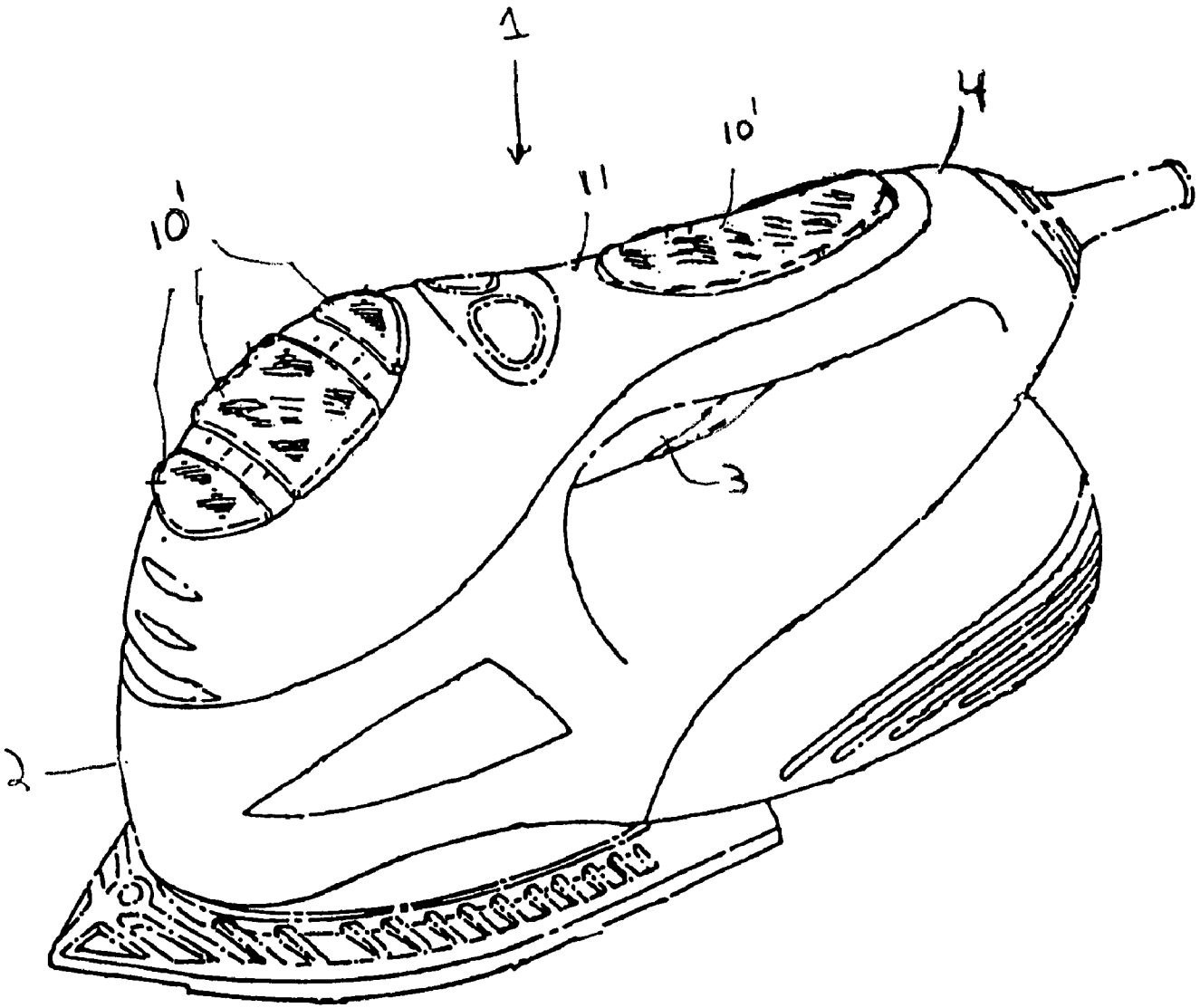
FIG. 1B is perspective view showing an alternative arrangement of a power tool according to the first embodiment.

FIG. 1B shows an alternative embodiment of the handle shown in FIG. 1A, in which three protrusions 10', each defining an air-filled chamber with a surface of the handle, are disposed on the forward part of handle 4. A single oval shaped protrusion 10' defining an air-filled chamber is disposed on the rearward part of the handle. In this latter embodiment, with respect to the forward part of handle 4, the rearward and forward protrusion 10' are generally half-moon shaped and may have a dimension in the longitudinal direction of the handle of 15 mm at the maximum region (along the center of the handle) and a maximum transverse width of 23.5 mm (along the flat edge.) The thickness of each protrusion 22 may be 12 mm. The middle protrusion 10' may have a dimension in the longitudinal direction of 15 mm and has a transverse width of 30 mm and thickness of 14 mm. The exposed region of the housing between the protrusions may have a dimension of 8 mm in the longitudinal direction, and the openings of securing plate 11 may have dimensions corresponding to that of the protrusions protruding therethrough. The housing at the location of middle protrusion 10' may have a maximum transverse width of 65 mm. Protrusion 10' on the rear handle portion may have a longitudinal dimension of 65 mm, a transverse width of 20 mm and a thickness of 17 mm. The transverse width of the rear handle portion may be 35 mm and the longitudinal dimension between the rear end of protrusion 10' and the end of the rear handle portion may be 38 mm. In each case, protrusion 10' may protrude outwardly from the surface of the securing plate for a distance of approximately 2.5 mm at the outer boundary of each protrusion 10' increasing to a distance of approximately 5 mm near the center of each protrusion 10'.

Figure 4A:
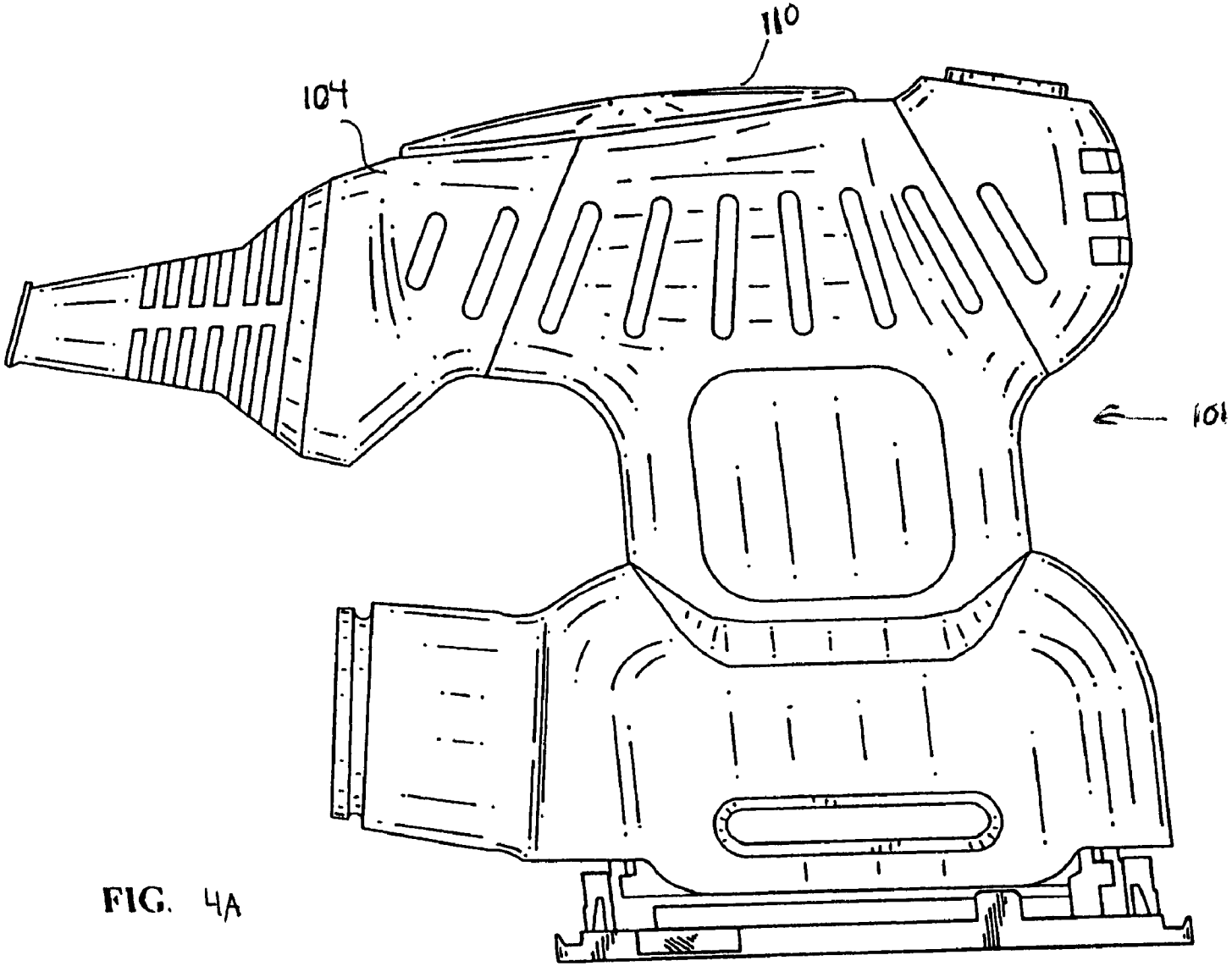
FIG. 4A is a side view of a housing of a power tool according to a second embodiment of the invention.
Figure 4B:
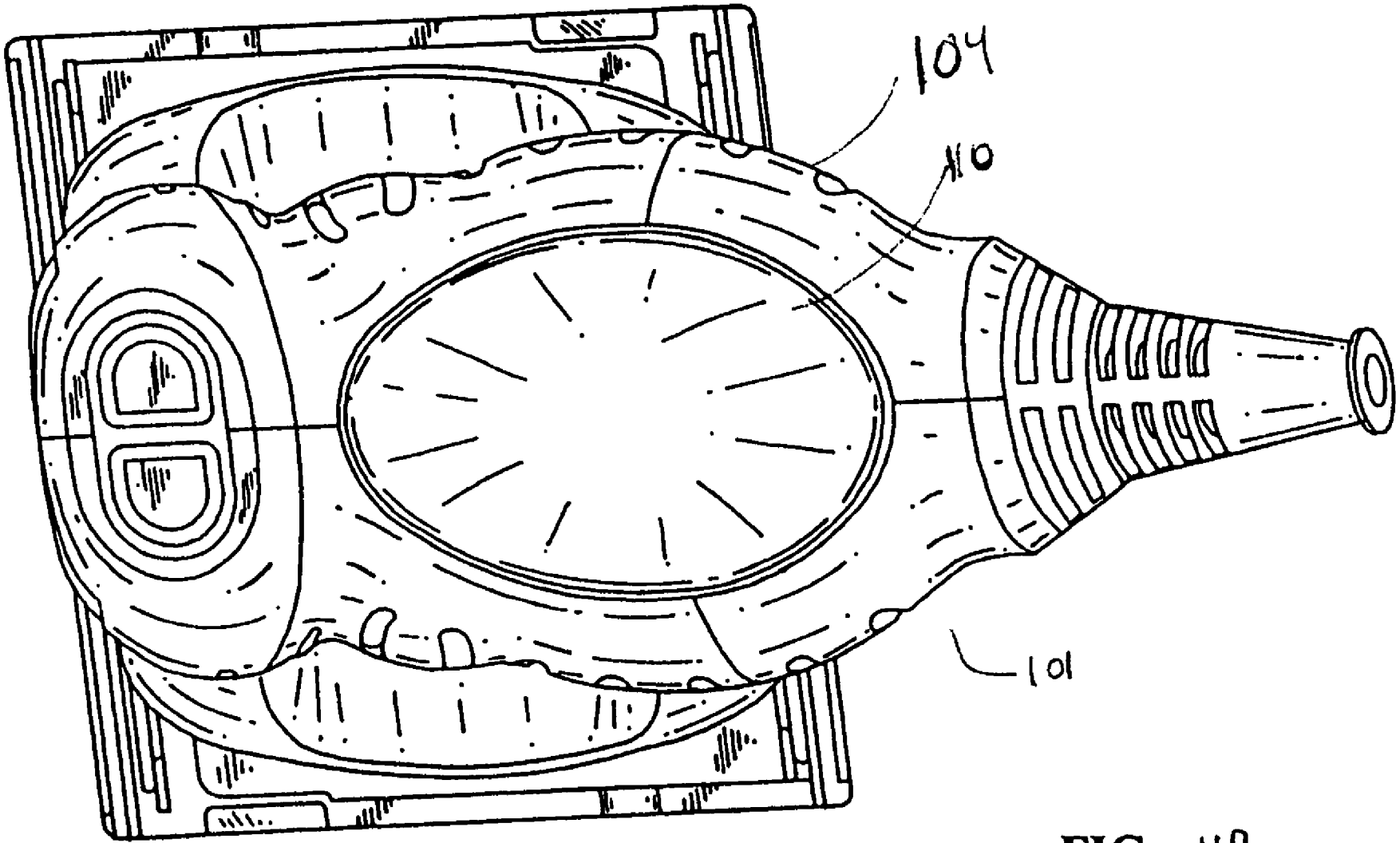
FIG. 4B is a top view of the housing shown in FIG. 4A.

Referring to FIGS. 4A to 4B, in which parts common to the embodiment of FIGS. 1 and 2 are denoted by like reference numerals but increased by 100, a handle 104 of a power tool 101 of a second embodiment of the invention, for example a sander, is shown. Protrusion 110 protruding through a top surface is oval and may have a maximum longitudinal dimension along the centerline of the top surface of 80 mm, a transverse width of 52 mm and a thickness of 16 mm. Protrusion 110 encloses an air-filled chamber and may be retained by an inner surface of the housing without a securing plate. Protrusion 110 may protrude outwardly from the surface of the housing for a distance of approximately 2.5 mm at the outer boundary increasing to a distance of approximately 5 mm near the center of the protrusion. The maximum transverse width of the handle may be 77 mm.

Figure 5:
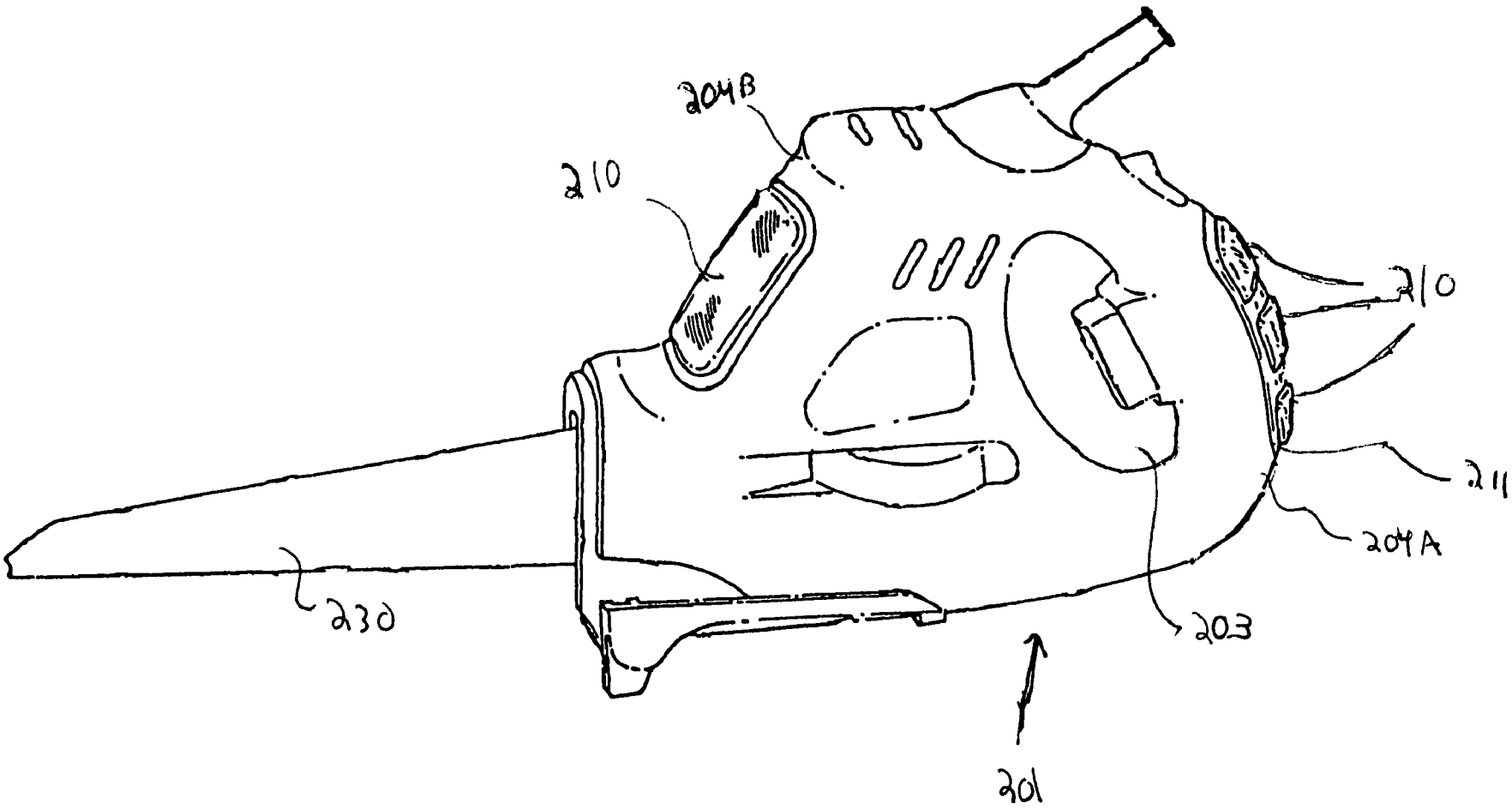
FIG. 5 is a perspective view of a housing of a power tool according to a third embodiment of the invention.

Referring to FIG. 5 in which parts common to the embodiment of FIGS. 4A and 4B are denoted by like reference numerals but increased by 100, a handle 204 of a power tool 201 of a third embodiment of the invention, for example a saw is shown. The saw includes a housing having a motor for reciprocating a drive shaft (not shown) to which saw blade 230 is attached to extend from a forward end. Opening 203 extends through the housing to form vertically extending rear handle portion 204A. Three protrusions 210 enclosing air-filled chambers extend outwardly from the rear surface of rear handle portion 204A. In a preferred embodiment, each protrusion 210 may have a longitudinal dimension (along the vertical length of the rear handle) of 26 mm and a transverse width of 17.5 mm, and a thickness of 9 mm. The spacing between each protrusion 210 may be 5 mm. Securing plate 211 has three apertures through which protrusions 210 protrude. Each opening may have a longitudinal dimension of 27 mm and a transverse width of 18 mm and the spacing between each opening may be 6 mm.

Forward handle portion 204B is disposed generally forwardly of the motor and sloped downwardly towards the blade. Protrusion 210 extends outwardly from forward handle portion 904B. In a preferred embodiment, this protrusion 210 has a vertical length along the slope of 60 mm, a transverse width of 30 mm and a thickness of 20 mm. The opening of the housing also may have a vertical length along the slope of 60 mm and a transverse width of 30 mm. In each case, protrusion 210 may extend outwardly from the surface of the housing for a distance of approximately 2.5 mm at the outer boundary of each protrusion increasing to a distance of approximately 5 mm near the center of each protrusion 210.

Figure 6B:
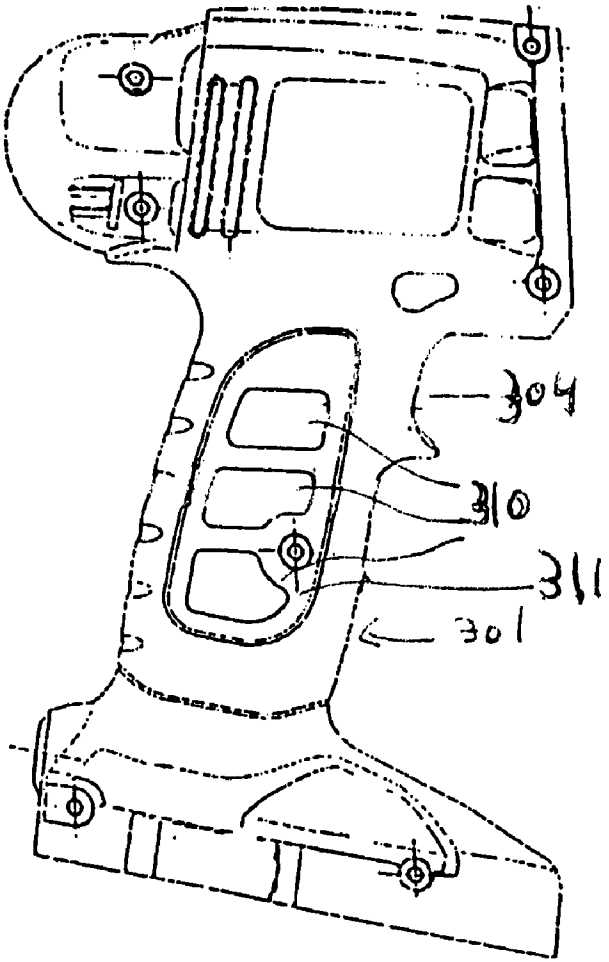
FIG. 6B is a side view of the housing of the power tool shown in FIG. 6A.
Figure 6A:
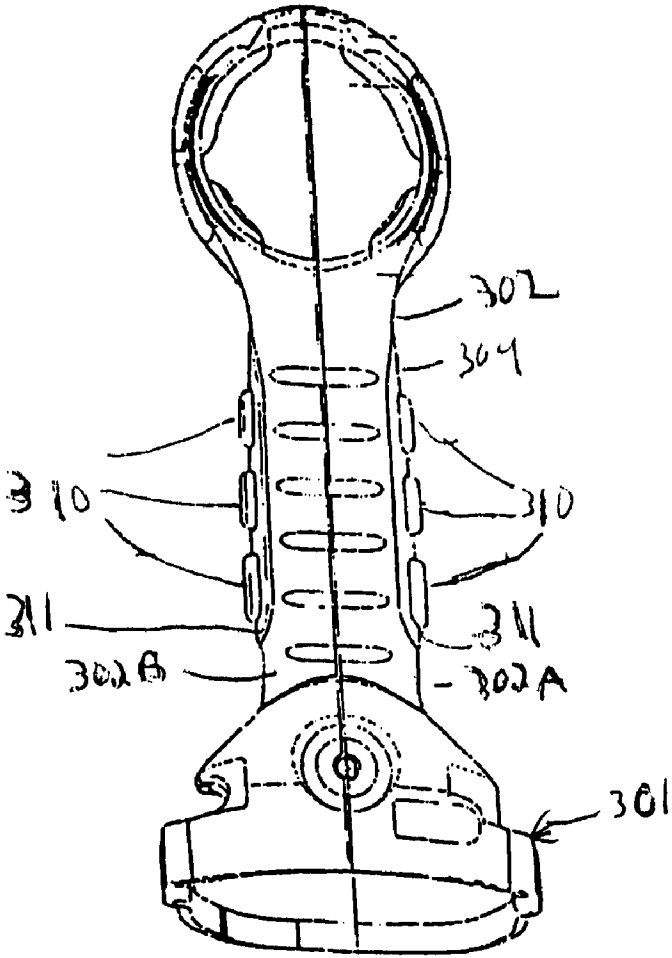
FIG. 6A is a front view of a housing of a power tool according to a fourth embodiment of the invention.

Referring to FIGS. 6A and 6B, in which parts common to the embodiment of FIG. 5 are denoted by like reference numerals but increased by 100, a handle 304 of a power tool 301 of a fourth embodiment of the invention, for example a drill, is defined by two halves 302A, 302B of housing 302. Each half 302A and 302B defines a recessed portion which accommodates three protrusions 310 defining air-filled chambers. Securing plates 311 of hard plastics material include screw bosses (unnumbered) and are secured to each housing half at the location of the recessed portions. Each securing plate 311 includes an appropriate aperture though which a protrusion 310 extends. Securing plates 311 are curved so as to substantially match the outer surface of the corresponding housing halves lateral of the protrusions, with the securing plates 311 and the corresponding housing half merging to form a substantially curved outer surface from which the protrusions extend. The outer surfaces of the protrusions may be curved as well.

With reference to FIG. 6B, in one embodiment the dimension of the middle and lower protrusion 310 at their greatest extent in the longitudinal direction of the handle may be 17 mm, while for the upper protrusion 310 the dimension may be 16 mm. The distance between protrusions 310 in the longitudinal direction may be 5 mm. The dimension of the upper and lower protrusion 310 at their greatest extent in the transverse direction of the handle may be 20 mm while for the middle protrusion 310 the transverse dimension may be 23 mm. The openings in securing plates 311 have dimensions corresponding to those of protrusions 310, while the overall dimension of securing plates 311 may be 75 mm in the longitudinal direction and 33 mm in the transverse direction. As measured in a vertical direction, the overall distance from the upper edge of securing plates 311 to the lower edge may be 70 mm, the overall distance from the upper edge of the uppermost protrusion 310 to the lower edge of the lowermost protrusion 310 may be 58 mm, and in the horizontal direction the overall distance from the left edge of the lowermost protrusion 310 to the right edge of the uppermost protrusion 310 may be 30 mm. Protrusions 310 may project outwardly from securing plates 311 by 2.5 mm.

It will be appreciated skilled in the art that the above embodiment has been described by way of example only, and not in any limitative sense, and that various alterations and modifications are possible without departure from the scope of the invention as defined by the appended claims.

The invention claimed is:

1. A power tool handle assembly with a gripping portion comprising:

a power tool having a housing and a motor within said housing for actuating an output member of the tool;

a gripping portion on the housing adapted to be engaged by the hand of a user of the tool and comprising:

at least one flexible member, at least one recess in said housing and at least one securing plate having at least one aperture therein such that at least one said securing plate clamps said at least one flexible member in said housing recess such that a gaseous vibration damping medium is retained between said flexible member and said housing such that when the handle is held by a user's hand in use, at least a portion of said flexible member containing the damping medium protrudes through said at least one aperture, and also during use substantially all of the vibration damping medium is in the portion of the flexible member protruding through said at least one aperture, and said securing plate including a fastening mechanism for securing said securing plate with said housing for covering said recess of the housing and said securing plate providing a surface adjacent said at least one flexible member.

2. A gripping portion on a power tool comprising:

the power tool including a housing and a motor within said housing for actuating an output member of the power tool, the gripping portion on the power tool adapted to be engaged by the hand of a user of the power tool, and said gripping portion further comprising:

at least one respective flexible sheet, at least one recess in said housing, and at least one securing plate secured to the housing and having at least one aperture enabling a portion of said at least one flexible sheet to protrude outwardly through said at least one aperture to define a chamber between the recess and said flexible sheet that includes a gaseous vibration damping medium, wherein the flexible sheet is mounted to the securing plate to retain said gaseous vibration damping medium between said at least one recess in said housing and said flexible sheet and wherein the chamber is bound by the housing recess and said flexible sheet and said flexible sheet directly contacting the housing recess adjacent said chamber.

3. A gripping portion according to claim 2, wherein at least one said flexible sheet is formed from a plurality of portions to protrude through a plurality of apertures in said security plate.

4. A gripping portion according to claim 2, wherein said gaseous vibration damping medium is air.

5. A power tool comprising a housing having a handle with a recess and a motor to actuate an output member of the tool, said handle comprising a gripping portion and a chamber enclosing a gaseous vibration damping medium extending outwardly from said gripping portion, at least a portion of said gripping portion surrounding said chamber and securing said chamber in said gripping portion, wherein said chamber is disposed relative to the gripping portion and said chamber positioned on said gripping portion for enabling parts of the user's hand, such as fingers, to contact the gripping portion and other parts, such as palm or heel, to contact the chamber for providing a dampening function for the user such that both the gripping portion and the chamber are simultaneously gripped during operation of the tool and a securing plate including at least one aperture through which said chamber protrudes, such that said gaseous vibration damping medium is retained in said chamber such that said chamber in use protrudes through said at least one aperture, and also during use substantially all of the vibration damping medium is in the chamber protruding through said at least one aperture, said securing plate forming at least a part of said gripping portion of said handle at the location of said securing plate and a fastening mechanism securing said securing plate with said housing and said securing plate covering said recess in said handle adjacent said chamber, said securing plate functioning as said gripping portion adjacent said chamber.

6. The power tool recited in claim 5, wherein said securing plate made of a material harder than material forming said chamber which includes said gaseous vibration damping medium.

7. A power drill comprising:

a main body;

a handle having opposite side surfaces each defining a gripping portion; and at least two chambers enclosing a gaseous vibration damping medium, said two chambers positioned on said opposite side surfaces of said handle, one said chamber protruding outwardly from said gripping portion of each said opposite side surface, said gripping portion covering a portion of said chamber, said chambers discreet from each other and said gripping portion including at least one recess for retaining said chambers on said handle such that said gaseous vibration damping medium is retained in said chambers such that said chambers, in use, protrude outward of said gripping portion, and also during use substantially all of the vibration damping medium is in the portion of the chamber protruding out of said gripping portion, and said gripping portion covers a portion of the handle adjacent said chambers and said gripping portion providing a gripping surface adjacent said chambers.

8. The drill recited in claim 7 comprising two additional chambers enclosing a gaseous vibration damping medium, two of said chambers disposed to protrude from each of said gripping region, each of said chambers discreet from each other.

9. The drill recited in claim 8, said drill further comprising two securing plates having an aperture therethrough, one said securing plates disposed on each said opposite side surface and defining at least a portion of the gripping portion of the handle at the locations of said securing plates, each said chamber protruding through one said aperture.

10. A power sander comprising:

a housing including a main body having an upper gripping portion;

a drive motor disposed within said main body;

a sanding platen extending downwardly from said main body and being driven by said drive motor; and a chamber enclosing a gaseous vibration damping medium, said chamber resting on a portion of said housing, said chamber protruding from said upper gripping portion, said gripping portion including an inner surface of the housing for retaining said chamber on said housing and said gripping portion covers said housing portion adjacent said chamber such that said gaseous vibration damping medium is retained in said chamber such that said chamber, in use, protrudes from said gripping portion, and also during use substantially all of the vibration damping medium is in the chamber protruding from said gripping portion, and said gripping portion providing a surface adjacent said chamber continuous with said housing.

11. A power sander comprising:

a housing including a main body;

a drive motor disposed within said main body;

a sanding platen extending downwardly from same main body and being driven by said drive motor;

a handle extending rearwardly from said main body; and a chamber enclosing a gaseous vibration damping medium, said chamber resting on a portion of said housing, said chamber protruding from an upper surface of said handle, a gripping portion including an inner surface of the housing for retaining said chamber on said housing and said gripping portion covers said housing portion adjacent said chamber such that said gaseous vibration damping medium is retained in said chamber such that said chamber, in use, protrudes from said gripping portion, and also during use substantially all of the vibration damping medium is in the chamber protruding from said gripping portion, and said gripping portion providing a surface adjacent said chamber continuous with said housing.

12. The sander recited in claim 11 comprising two said chambers enclosing the gaseous vibration damping medium, each of said chambers discreet from each other and protruding from an upper surface of said handle.

13. A power saw comprising:

a main body housing including an opening therethrough to define a handle rearwardly of the opening, said housing adapted to receive a saw blade at a forward end;

a motor disposed in said main body, said motor driving said saw blade; wherein, said handle includes a gripping portion, a recess and a chamber enclosing a gaseous vibration damping medium protruding outwardly from said gripping portion, said chamber disposed relative to the gripping portion and said chamber positioned on said gripping portion for enabling parts of the user's hand, such as fingers, to contact the gripping portion and other parts, such as palm or heel, to contact the chamber for providing a dampening function for the user such that both the gripping portion and the chamber are simultaneously gripped during operation of the tool and a securing plate including at least one aperture through which said chamber protrudes such that said gaseous vibration damping medium is retained in said chamber recess such that said chamber, in use, protrudes through said at least one aperture, and also during use substantially all of the vibration damping medium is in the chamber protruding through said at least one aperture, said securing plate forming at least a part of said gripping portion of said handle at the location of said securing plate and a fastening mechanism securing said securing plate with said housing and said securing plate covering a portion of said handle adjacent said chamber, said securing plate functioning as said gripping portion adjacent said chamber.

* * * * *